US005501451A

United States Patent [19]

Slusarczyk

[11] Patent Number: 5,501,451

[45] Date of Patent: Mar. 26, 1996

[54] WARMUP DEVICE FOR RACKET SPORTS

[76] Inventor: Robert Slusarczyk, 153 Belleville Ave., Bloomfield, N.J. 07003

[21] Appl. No.: 249,345

[22] Filed: May 27, 1994

[51] Int. Cl.[6] ..... A63B 69/38

[52] U.S. Cl. ..... 273/29 A; 273/29 R; 273/73 R; 273/67 R

[58] Field of Search ..... 273/73 R, 73 C, 273/29 R, 29 A, 67 R; 73/170.05, 170.01

[56] References Cited

U.S. PATENT DOCUMENTS

| | | | |
|---|---|---|---|
| 1,401,626 | 12/1921 | Mader | 73/170.05 X |
| 3,715,829 | 2/1973 | Hamilton | 273/73 C X |
| 4,558,862 | 12/1985 | Kelly | 73/170.05 X |
| 5,224,703 | 7/1993 | Osher | 273/67 R |
| 5,269,511 | 12/1993 | Chavez | 273/29 A X |

FOREIGN PATENT DOCUMENTS

| | | | |
|---|---|---|---|
| 3834108 | 4/1990 | Germany | 273/29 R |

OTHER PUBLICATIONS

"Racquet Power Chute", Kytec Innovative Sports Equipment, Inc., (undated), 2 pp.

*Primary Examiner*—Raleigh W. Chiu

*Attorney, Agent, or Firm*—Siegmar Silber

[57] ABSTRACT

A racket sport training device is disclosed. The training device is usable in conjunction with any strung racket, and includes a pocket-like structure fashioned from a flexible, rip-stop nylon material. The opening of the pocket has a perimeter that approximates the perimeter of the racket frame to which it is attached, and, when the racket is used with the training device in place, air is entrapped in the pocket. The entrapped air adds additional stress to the swing so that the player using the device for warmup exercise faces higher, racket-head resistance. This results in faster warmup with the encumbered swing constituting a functional exercise—one that uses the same musculature as is used in actual play. The device is further optionally adapted for tennis service training by having one or more zippers to bleed air from the device. A scale marking is provided adjacent the zipper for reproducibly setting the level of the racket head resistance desired for service warmup.

19 Claims, 3 Drawing Sheets

WARMUP DEVICE FOR RACKET SPORTS

BACKGROUND OF THE INVENTION

1. Field of the Invention

This invention relates to a warmup device for racket sports, and, more particularly, to a wind-resistant hood which attaches to the frame of a sporting racket. When installed, the warmup hood does not interfere with the racket surface so that the player can stroke the ball in a manner simulating ordinary play. Further, as the player takes his warmup strokes with the warmup hood mounted on the actual racket that is to be used during play, the device provides pre-play functional exercise with increased racket-head resistance and, unlike practice rackets, maintains the "feel" of the racket used in play.

2. Information Disclosure Statement Under 37 CFR Secs. 1.97 and 1.98

While preparing for this application, several U.S. patents became known to the inventor hereof by his considering various sports training devices found in the classes and subclasses hereinbelow.

CLASS/SUBCLASS

273/26, 29, 73, 74

D21/210, 211, 212

The following patents became known during the inventor's preparation.

| ITEM NO. | U.S. PAT. NO. | INVENTOR | ISSUE DATE |
|---|---|---|---|
| 1 | 3,048,399 | L. F. Breitbach | 8/7/62 |
| 2 | 3,503,611 | F. A. McPherson | 3/31/70 |
| 3 | 3,521,883 | F. G. Hamilton | 5/28/70 |
| 4 | 3,716,239 | N. G. Goudreau | 2/13/73 |
| 5 | 3,820,785 | P. W. Occhipinti | 5/28/74 |
| 6 | 4,032,142 | R. M. Andrews | 5/28/77 |
| 7 | 4,080,665 | M. Hodes | 3/28/78 |
| 8 | 4,671,510 | H. Schoenwetter | 6/9/87 |
| 9 | 5,186,699 | D. A. Dimmig | 2/16/93 |

In considering the various patents known to the inventor hereof the following discussion is provided:

U.S. Pat. No. 3,716,239—Goudreau

Goudreau discloses a warm-up weight for athletic implements such as golf clubs having an enlarged head with a tapered stub having its point of smallest diameter connected to a tapered shaft having its narrower end connected to the stub.

U.S. Pat. No. 3,820,785—Occhipinti et al.

Occhipinti et al. teaches a practice tennis racket having a handle and a racket head provided with a masking cover overlying the strings on each side of the racket head. The cover of the disclosed device masks a preselected area of the racket head to leave a desired area of the strings exposed for striking a ball in a conventional manner.

U.S. Pat. No. 4,032,142—Andrews

Andrews teaches a practice tennis racket having a handle and peripheral frame corresponding to a conventional tennis racket. Extending across the frame is a flexible barrier net and a gridwork of yielding retaining strings. When a tennis ball is truck with the racket, the retaining strings permit the ball to pass therethrough to be caught in the net, with the strings retaining the ball in the net.

U.S. Pat. No. 4,671,510—Schoenwetter

This invention teaches the use of a racket cover to function as a warm-up aid by providing balanced weight holding pockets on the face of the cover and placing weights symmetrically around the center line of the cover.

U.S. Pat. No. 5,186,699—Dimmig

Here a light weight plastic "pan-like" device is attached to a sports racket by a clamp in the center of the playing surface of the racket. When attached, the implement is swung in any of the normal stroking motions.

The submission of the above list of documents is not intended as an admission that any such document constitutes prior art against the claims of the present application. Applicant does not waive any right to take any action that would be appropriate to antedate or otherwise remove any listed document as a competent reference against the claims of the present application. uncovered, it is important to further categorize the items.

None of the prior art devices known to the applicant addresses the peculiar needs of a racket sport aerodynamic warmup device such is provided by the present disclosure.

SUMMARY

In general terms, the invention disclosed hereby is a racket sport training device which is particularly well-suited to the sport of tennis. While the device, as shown in FIGS. 1, 2 and 3, is used in conjunction with any strung racket, the hereinbelow described pocket-like structure is constructed from a flexible, rip-stop nylon material specifically for the tennis enthusiast. The opening of the pocket has a perimeter that approximates the perimeter of the racket frame to which it is attached, and, when the racket is used with the training device in place, air is entrapped in the pocket. The entrapped air adds additional stress to the swing so that the player using the device for warmup exercise faces higher racket head resistance. This results in faster warmup with the encumbered swing constituting a functional exercise —one that uses the same musculature as is used in actual play.

The embodiment shown in FIGS. 4, 5 and 6 is adapted for tennis service training by having one or more zippers to bleed air from the device. A scale marking is provided adjacent the zipper for reproducibly setting the level of the racket head resistance desired for service warmup.

OBJECTS AND FEATURES OF THE INVENTION

It is an object of the present invention to provide a warmup hood that is removably attachable to the frame of a sporting racket.

It is a further object of the present invention to provide a wind-resistant hood for use during functional exercises performed prior to participating in a racket sport.

It is yet another object of the present invention to provide a warmup hood for use as a service aid.

It is still yet another object of the present invention to provide a variably resistant warmup device that can be adjusted readily.

It is a feature of the present invention that the warmup hood attachment and detachment can be quickly accomplished.

It is another feature of the present invention to have an adjustable capacity control to vary the wind resistance.

It is yet another feature of the present invention to have a vent indicator for reproducibility.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

In general, the present invention is used for racket sport warmup and, specifically, physical fitness and muscular development. The present invention is a training device for strengthening the arm, shoulder, and back muscles of players utilizing sporting rackets, such as tennis rackets. The training device hereof utilizes aerodynamic drag principles to produce additional racket head resistance against the motion of the stroke. The device of the present invention is constructed from a light weight rip-stop nylon material and is described herein in terms of application to tennis. Although the physical dimensions of the present invention vary based on the racket with which the device is used, when applied to other racket sports, the same novel features as enumerated hereinbelow are employed.

The ideal form of warm-up exercises is called "functional exercise" by physical therapists. Basically, a functional exercise is warm-up exercise wherein the specific muscle groups used during the warm-up stroking motions are the same, albeit exaggerated, as those used during the playing strokes of a particular sport. In the functional exercise the muscle groups are stressed by greater than normal opposing forces. To have maximal beneficial effect, the additional forces employed during functional exercises must be evenly distributed over the entire stroking motion (i.e. from the ready position to the backswing through to the follow-through) and must not alter the motion. The novel and unobvious invention hereof employs the principles of aerodynamic drag for exercise while enabling the player to stroke the tennis ball.

Figure 1:
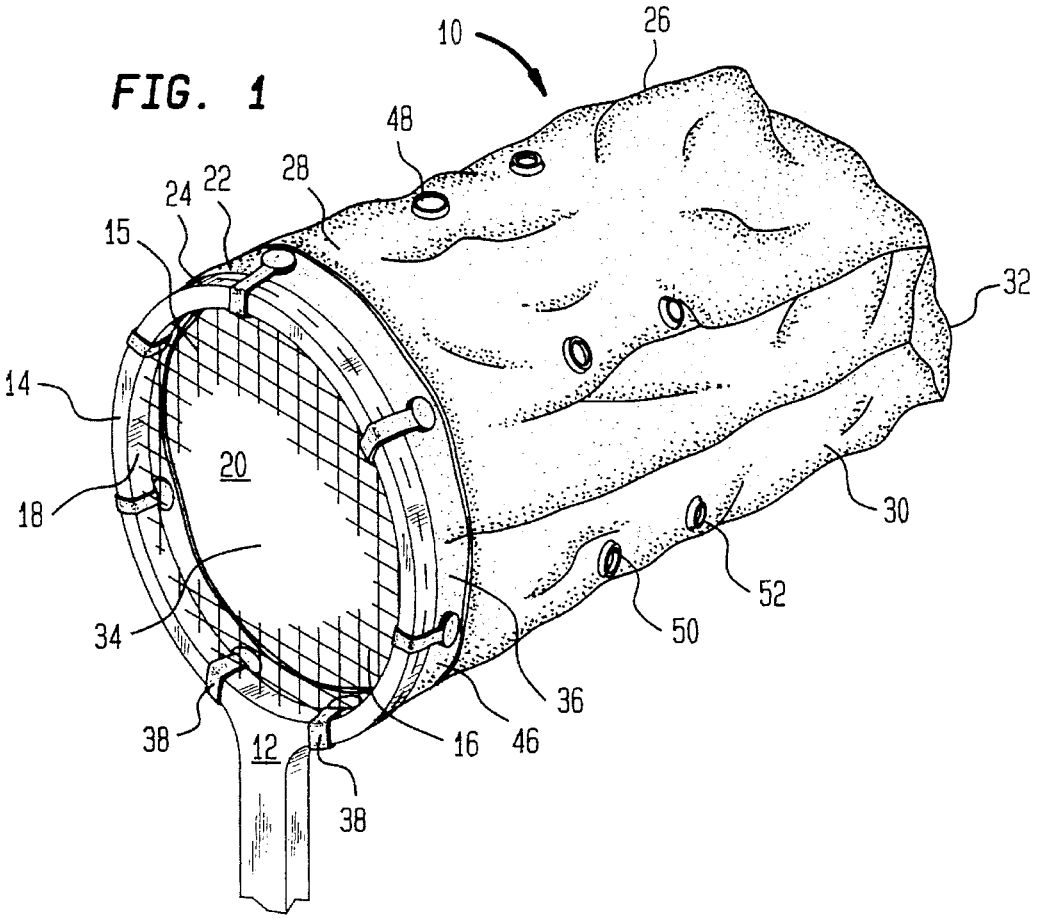
FIG. 1 is a perspective view of the first embodiment of the warmup device for racket sports of the present invention, said device shown attached to the frame of a sporting racket while being used prior to play.

In FIG. 1, the warmup and serving aid device of this invention is shown with the device mounted on a tennis racket and is referred to generally by the reference designator 10. The device 10 while shown mounted on tennis racket 12 may be used in conjunction with any sporting racket that has a frame and is strung in a manner similar thereto. For descriptive purposes, the tennis racket shown has an annular frame 14, and one or more strings 15, 16 tensioned and interwoven thereacross. The racket 12 has a plurality of holes 18 through and spaced apart about the frame 14. The string 16, when tensioned, as previously described, forms a playing surface 20. The device 10 is constructed of a flexible wind-resistant material, such as rip-stop nylon material, the mating of the perimeters 22 and 24 need not be exact. The device 10 is constructed in the form of a pocket 26 having a wall 28. While the device 10 of the invention is shown as being generally cylindrical, other formatives, such as a frustum or cone, may function adequately for the purposes described hereinbelow. In the configuration of this embodiment, the wall 28 of pocket 26 is constructed with a sidewall portion 30 and an end or bottom portion 32, the latter closing one end of the cylindrical form with the other end being an opening or aperture 34. Adjacent the perimeter 22, a reinforcement band 36 is attached to wall 28.

Figure 2:
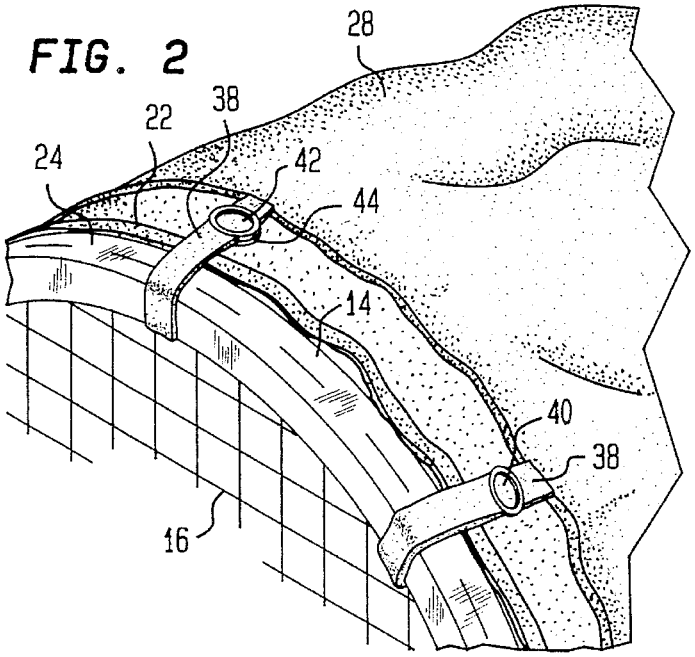
FIG. 2 is an enlarged detail of the perspective view of FIG. 1 showing a portion of the frame and racket head in relation to two adjacent tabs with snap-type closures.
Figure 3:
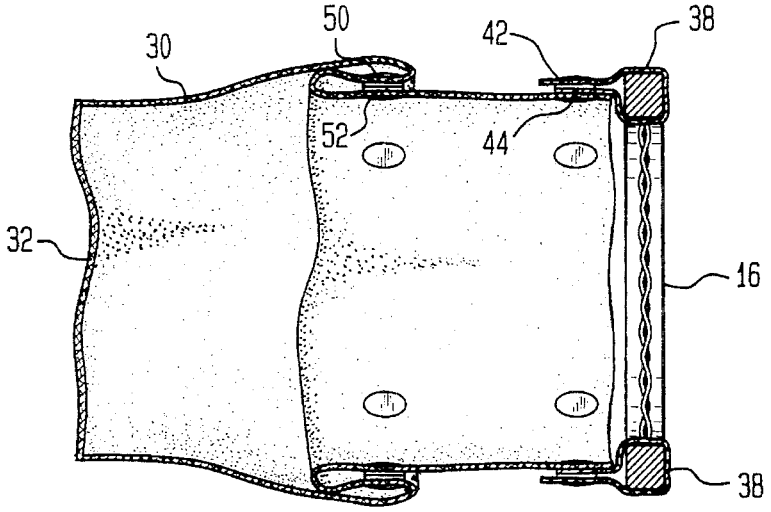
FIG. 3 is a cross-sectional view of the invention of FIG. 1 and shows the device shortened for less air resistance during use.

Referring now to FIGS. 2 and 3, detailed views of FIG. 1 are shown. Here, two adjacent attachment tabs 38 are shown threaded through the spacing between the string 16 and the frame 14 and looped thereabout so as to be attachable to the wall 28 at the perimeter 22. While any of numerous attachment devices may be used, in the embodiment shown the attachment means is a two-part snap 40 having a male portion 42 attached to the surface of the tab 38 and a female portion 44 attached to the outer surface 46 of the reinforcement band 36. Additionally in the first embodiment, a plurality of snaps 48 are arrayed about the device 10 with the male portions 50 in a row and a plurality of female portions 52 in yet another row.

Figure 4:
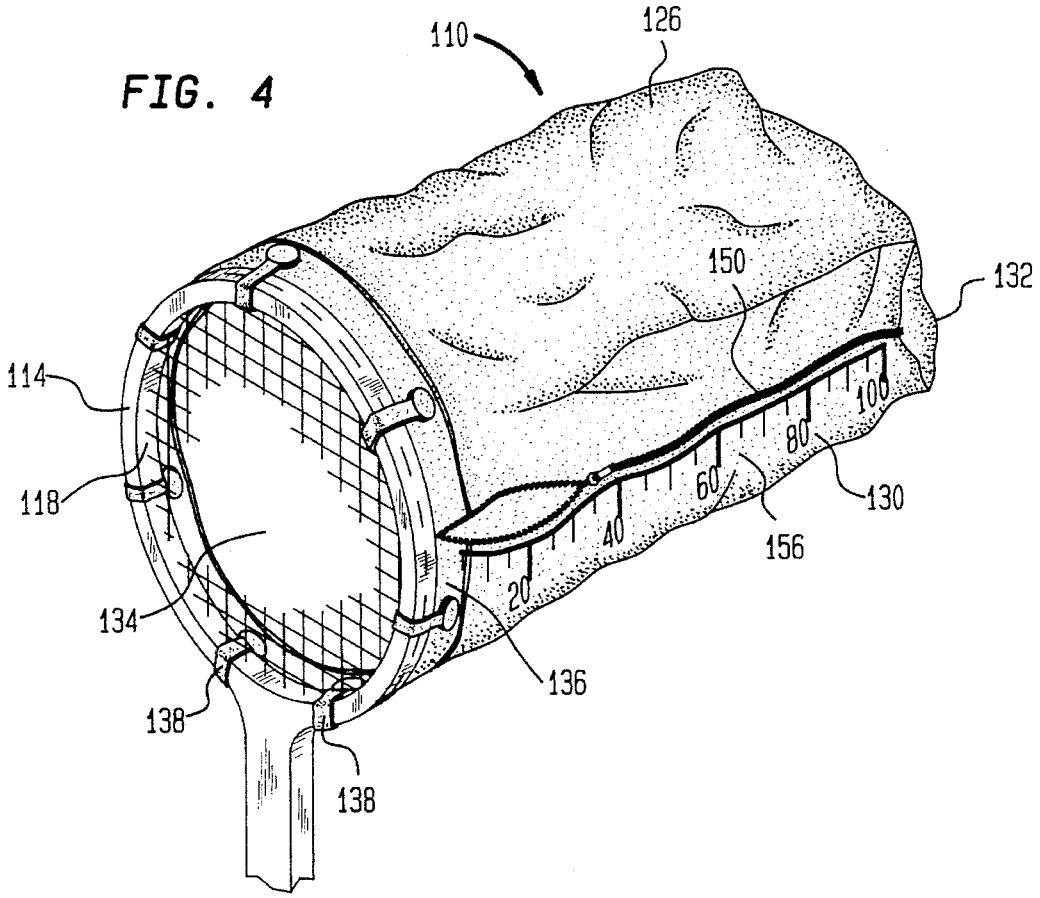
FIG. 4 is a perspective view of the second embodiment of the warmup device for racket sports of the present invention, said device, shown attached to the frame of a tennis racket while being used prior to play, is similar to the first embodiment, but has an air regulating vent arrangement.
Figure 5:
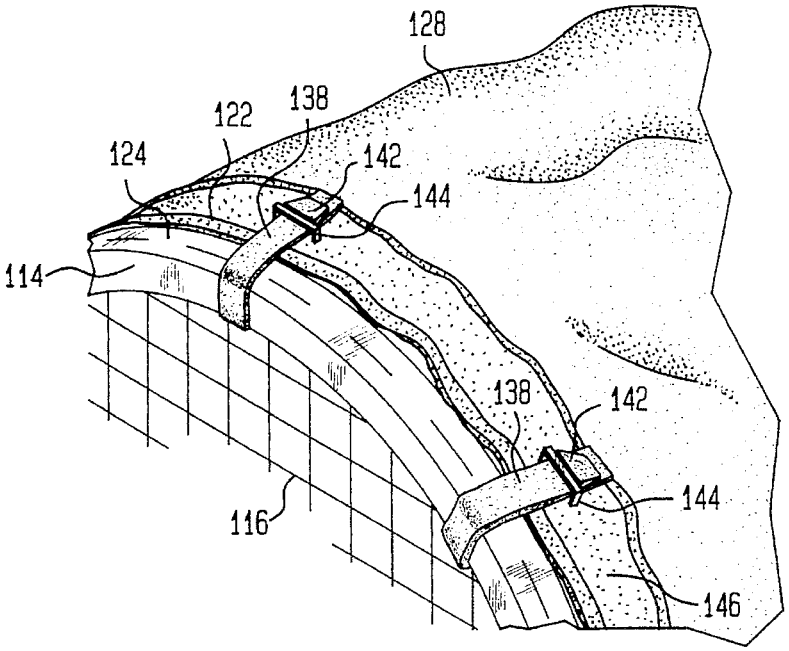
FIG. 5 is an enlarged detail of the perspective view of FIG. 1 showing a portion of the frame and racket head in relation to two adjacent tabs with spring-type closures; and, FIG. 6 is a front elevational view of the invention taken opposite a zipper vent with a graduated scale thereabout.
Figure 6:
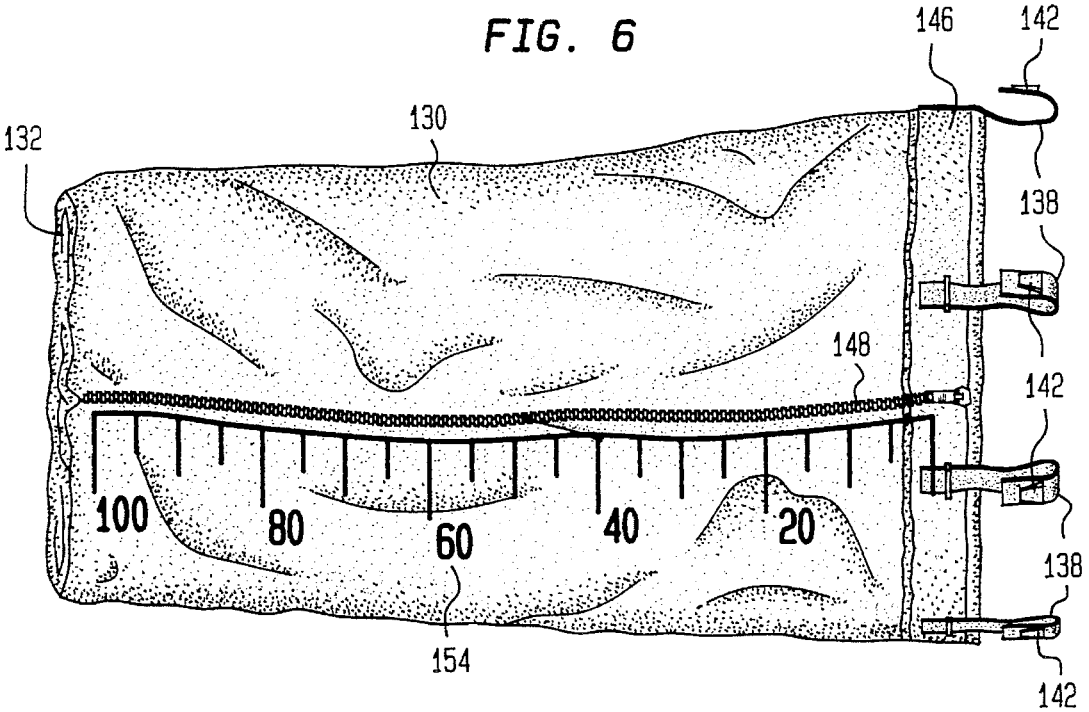

Shown in FIGS. 4, 5, and 6, the description which follows is of a second embodiment of the warm up and serving aid of this invention. For ease of comprehension, where similar parts are used reference designators "100" units higher are employed. Thus, the reinforcement band 136 of the second embodiment is analogous to the reinforcement band 36 of the first embodiment. nI FIG. 4, a second embodiment of this invention is shown with the device mounted on a tennis racket and is referred to generally by the reference designator 110. As in the first embodiment, the device 110 while shown mounted on a tennis racket 112 may be used in conjunction with any sporting racket that has a frame and is strung in a manner similar thereto. For descriptive purposes, the tennis racket shown has an annular frame 114, and one or more strings 116 tensioned and interwoven thereacross. The racket 112 has a plurality of holes 118 through and spaced apart about the frame 114. The string 116, when tensioned, as previously described, forms a playing surface 120. The device 110 is constructed of a flexible wind-resistant material, such as rip-stop nylon material, the mating of the perimeters 122 and 124 need not be exact. The device 110 is constructed in the form of a pocket 126 having a wall 128. While the device 110 of the invention is shown as being generally cylindrical, other formatives, such as a frustum or cone, may function adequately for the purposes described hereinbelow. In the configuration of this embodiment, the wall 128 of pocket 126 is constructed with a sidewall portion 130 and a circular end or bottom portion 132, the latter closing one end of the cylindrical form with the other end being an opening or aperture 134. Adjacent the perimeter 122, a reinforcement band 136 is attached to wall 128.

Referring now to FIGS. 5 and 6, detailed views of FIG. 4 are shown. Here, two adjacent attachment tabs 138 are shown threaded through the spacing between the string 116 and the frame 114 and looped thereabout so as to be attachable to the wall 128 at the perimeter 122. In contrast to the first embodiment, here the attachment means is a quick-release latch 140 having a spring-operated, tongue-like male portion 142 attached to the surface of the tab 138 and a catch or female portion 144 attached to the outer surface 146 of the reinforcement band 136. Additionally in this embodiment, one or more zipper vents (two being shown) 148 and 150 are emplaced axially along the wall to permit controlled bleeding of the entrapped air during warmup. These adjustments are discussed herein in the description of operations. Scales 154 and 156 are imprinted on the device 10 and alongside each zipper 148 and 150 so that the user can reproducibly arrange the amount of aerodynamic drag to be employed during a series of warmup serves. In operation the warmup and serving aid 10 is first attached to the tennis racket as shown in FIGS. 1 or 4. Then, the racket is positioned so that the device 10 trails the racket surface.

The player first warms up by slowly executing 10 to 15 forehand swings. In warming up for the forehand, the racket is set, the feet are planted, and a full swing, including the follow-through, is completed. During the initial portion of the swing, the warmup device becomes fully inflated. The inflation of the device becomes a visual prompt to player who is warming up. The device deflates upon abruptly stopping the racket head. A full smooth swing then becomes indicated by the device inflating early in the swing and staying inflated through the follow-through phase thereof. In the course of warming up, when the drag needs to be reduced, the device of the first embodiment is shortened as shown in FIG. 3; and in the second embodiment, the zippers are opened to predetermined settings. Next, the player slowly swings through his overhead/serve 10–15 times. Here the racket reaches the apex of the swing; the device inflates with a popping sound. By the audible confirmation of reaching the peak of this swing, the player can sense an improvement in his serve. The timing of the "pop" tells him how to adjust his serves. He then continues the swing by following-through and completes this portion of the overhead/serve with the extra racket head resistance.

The warmup device provides a methodical way for tennis players to strengthen and stretch the exact muscles used with every type of tennis stroke—forehand, backhand, overhead, or serve. The second embodiment hereof with adjustable bleed, enables the more highly proficient player to design sets of repetitive service warm ups at various levels of resistance. With this feature the player can serve a set at low resistance, then one at high resistance, and finish warm up with a third set at low resistance.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A racket-sport training device for use on a sporting racket having a handle and a planar annular frame with strings supported thereby, said training device capable of use during warmup and service training comprising:

a pocket formed from a flexible, wind-resistant material capable of entrapping air therewithin, dimensioned so as, when used for service training, to provide audible confirmation of proper execution of service, said pocket, in turn, further comprising;

a wall; and, wind-resistance adjustment means for adjusting, during exercises prior to play, the aerodynamic drag thereof, said wind-resistance adjustment means mounted in said wall altering the retention capacity of the pocket;

an aperture at one end of said pocket having a perimeter dimensioned to be substantially equal to the perimeter of said annular frame;

a plurality of attachment means for removably attaching said pocket to and from said annular frame without interfering with the strings thereof; and, said training device when used in combination with the racket is capable for use in functional exercises prior to play through adding stress to practice strokes by increasing the aerodynamic drag of the racket head and when used for said service training, providing audible confirmation thereof.

2. A racket-sport training device as described in claim 1 wherein said annular frame has a plurality of frame holes therethrough for supporting and tensioning said strings and wherein said attachment means further comprises:

a plurality of elongated tabs, each fastened at one end thereof to the edge of said pocket adjacent said aperture and capable of extending beyond the pocket, between two adjacent frame holes, and about the frame to a point of fastening;

a plurality of male securement portions mounted to said pocket adjacent said aperture with at least one being provided for each tab; and, a plurality of female securement portions mounted to said tab at the end opposite the fastened end with at least one being provided for each corresponding male securement portion, each said female securement portion for cooperatively functioning with a corresponding male securement portion to attach said pocket to said annular frame.

3. A racket-sport training device as described in claim 2 wherein each said male securement portion is a male snap portion and each said female securement portion is a female snap portion, said male snap portion capable of removably and frictionally securing to and from the corresponding said female snap portion.

4. A racket-sport training device as described in claim 2 wherein each said male securement portion is a male latch portion and each said female securement portion is a female latch portion, said male latch portion capable of removably attaching to and from the corresponding said female latch portion.

5. A racket-sport training device as described in claim 1 wherein said wind-resistance adjustment means is a pocket shortening device decreasing the wall dimension and correspondingly the pocket air capacity and the aerodynamic drag.

6. A racket-sport training device as described in claim 5 wherein said pocket shortening device are two substantially parallel rows of snaps which when connected the one to the other reduces the pocket size and simultaneously the aerodynamic drag.

7. A racket-sport training device as described in claim 1 wherein said wind-resistance adjustment means is at least one venting zipper which, when opened, bleeds off the entrapped air and decreases correspondingly the aerodynamic drag and the pocket air capacity.

8. A tennis training device for use on a tennis racket having a handle and a planar annular frame with a plurality of frame holes therethrough for supporting and tensioning said strings and wherein said attachment means strings supported thereby, said training device comprising:

a pocket formed from a flexible, rip-stop Nylon material dimensioned so as, when used for service training, to provide audible confirmation of proper execution of service, said pocket, in turn, further comprising;

a wall; and, a wind-resistance adjustment means for adjusting, during exercises prior to play, the aerodynamic drag thereof, said wind-resistance adjustment means mounted in said wall altering the retention capacity of the pocket;

an aperture at one end of said pocket having a perimeter dimensioned to be substantially equal to the perimeter of said annular frame;

a plurality of attachment means for removably attaching said pocket to and from said annular frame without interfering with the strings thereof, said attachment means, in turn, further comprises:

a plurality of elongated tabs, each fastened at one end thereof to the edge of said pocket adjacent said aperture and capable of extending beyond the pocket, between two adjacent frame holes, and about the frame to a point of fastening;

a plurality of male securement portions mounted to said pocket adjacent said aperture with at least one being provided for each tab; and, a plurality of female securement portions mounted to said tab at the end opposite the fastened end with at least one being provided for each corresponding male securement potion, each said female securement portion for cooperatively functioning with a corresponding male securement portion to attach said pocket to said annular frame.

9. A tennis training device as described in claim 8 wherein each said male securement portion is a male snap portion and each said female securement portion is a female snap portion, said male snap portion capable of removably and frictionally securing to and from the corresponding said female snap portion.

10. A tennis training device as described in claim 9 wherein each said male securement portion is a male latch portion and each said female securement portion is a female latch portion, said male latch portion capable of removably attaching to and from the corresponding said female latch portion.

11. A tennis training device as described in claim 9 wherein said wind-resistance adjustment means is a pocket shortening device decreasing the wall dimension and correspondingly the pocket air capacity and the aerodynamic drag.

12. A tennis training device as described in claim 11 wherein said pocket shortening device are two substantially parallel rows of snaps which when connected the one to the other reduces the pocket size and simultaneously the aerodynamic drag.

13. A tennis training device as described in claim 8 wherein said wind-resistance adjustment means is a venting zipper which, when opened, decreases correspondingly the pocket air capacity and the aerodynamic drag.

14. A tennis service training device for use on a tennis racket having a handle and a planar annular frame with strings supported thereby, said training device comprising:

a pocket formed from a flexible, wind-resistant material capable of entrapping air therewithin, said pocket, in turn, comprising:

a wall;

wind-resistance adjustment means for adjusting, during exercises prior to play, the aerodynamic drag thereof, said wind-resistance adjustment means mounted in said wall altering the retention capacity of the pocket;

an aperture at one end of said pocket having a perimeter dimensioned to be substantially equal to the perimeter of said annular frame; and, a plurality of attachment means for removably attaching said pocket to and from said annular frame without interfering with the strings thereof;

whereby, upon attachment of the training device, the racket and training device are usable for functional exercises prior to play, said training device adding stress to practice strokes by inreasing the aerodynamic drag of the racket head.

15. A tennis service training device as described in claim 14 wherein said wind-resistance adjustment means is at least one venting zipper which, when opened, bleeds off the entrapped air and decreases correspondingly the aerodynamic drag and the pocket air entrapment capacity.

16. A tennis service training device as described in claim 15 further comprising a scale marking adjacent said zipper for reproducibly setting the opening thereof.

17. A tennis service training device as described in claim 14 further comprising a scale marking adjacent said wind-resistance adjustment means for reproducibly setting the opening thereof.

18. A tennis service device as described in claim 14 wherein said annular frame has a plurality of frame holes therethrough for supporting and tensioning said strings and wherein said attachment means further comprises:

a plurality of elongated tabs, each fastened at one end thereof to the edge of said pocket adjacent said aperture and capable of extending beyond the pocket, between two adjacent frame holes, and about the frame to a point of fastening;

a plurality of male securement portions mounted to said pocket adjacent said aperture with at least one being provided for each tab; and, a plurality of female securement portions mounted to said tab at the end opposite the fastened end with at least one being provided for each corresponding male securement portion, each said female securement portion for cooperatively functioning with a corresponding male securement portion to attach said pocket to said annular frame.

19. A tennis service training device as described in claim 18 wherein each said male securement portion is a male snap portion and each said female securement portion is a female snap portion, said male snap portion capable of frictionally securing to and from the corresponding said female snap portion.

* * * * *